US009913322B2

(12) United States Patent
Davies

(10) Patent No.: US 9,913,322 B2
(45) Date of Patent: Mar. 6, 2018

(54) CONTROLLED DOOR OPENING IN DOMESTIC APPLIANCES

(75) Inventor: Daniel Davies, Llanelli (GB)

(73) Assignee: Panasonic Manufacturing UK Ltd., Cardiff (GB)

( * ) Notice: Subject to any disclaimer, the term of this patent is extended or adjusted under 35 U.S.C. 154(b) by 1904 days.

(21) Appl. No.: 12/809,081

(22) PCT Filed: Dec. 12, 2008

(86) PCT No.: PCT/EP2008/010587
§ 371 (c)(1),
(2), (4) Date: Dec. 22, 2010

(87) PCT Pub. No.: WO2009/080229
PCT Pub. Date: Jul. 2, 2009

(65) Prior Publication Data

US 2011/0095019 A1 Apr. 28, 2011

(30) Foreign Application Priority Data

Dec. 21, 2007 (GB) ..... 0724997.2

(51) Int. Cl.
*H05B 6/64* (2006.01)
*H05B 3/02* (2006.01)
*E05F 15/02* (2006.01)

(52) U.S. Cl.
CPC ..... *H05B 6/6417* (2013.01); *H05B 6/6414* (2013.01)

(58) Field of Classification Search
CPC ..... H05B 6/6414; H05B 6/6417
(Continued)

(56) References Cited

U.S. PATENT DOCUMENTS 4,825,027 A 4/1989 Yoon
4,982,063 A 1/1991 Tsunekawa et al.
(Continued)

FOREIGN PATENT DOCUMENTS

EP 0 342 307 11/1989
EP 0 371 611 6/1990
(Continued)

OTHER PUBLICATIONS

International Search Report and Written Opinion Search Report corresponding to PCT/EP2008/010587, dated Jun. 18, 2009, 12 pages.
(Continued)

*Primary Examiner* — Quang Van
(74) *Attorney, Agent, or Firm* — Myers Bigel, P.A.

(57) ABSTRACT

The invention provides a door opening mechanism for a domestic appliance, for example a microwave door. The domestic appliance includes a housing, a front door, and a resilient member for urging the door open. The mechanism is adapted to be located within the housing and includes a retention mechanism which is engagable with the door and is movable between a first configuration where there door is retained in a closed position and a second configuration where the door is in a non-retained, open, position. The door also includes a cam with a plurality of cam surfaces. The door includes a door key with an inclined portion engagable with an edge of a sloping section of a hollow slot in the door molding, arranged such that a user is able to manually over-ride the opening mechanism and open the door by means of pulling.

22 Claims, 5 Drawing Sheets

(58) Field of Classification Search
USPC ..... 219/679, 722–724, 398, 412–414; 126/197, 192, 19 R; 200/50.1, 50.13, 200/50.16; 292/95, 109–112, 201
See application file for complete search history.

(56) References Cited

U.S. PATENT DOCUMENTS

| | | | | |
|---|---|---|---|---|
| 6,137,096 | A * | 10/2000 | Seo | 219/722 |
| 2004/0113438 | A1 | 6/2004 | Kachouh | |
| 2005/0121919 | A1* | 6/2005 | Smock et al. | 292/110 |

FOREIGN PATENT DOCUMENTS

| | | |
|---|---|---|
| EP | 0 371 611 | 11/1990 |
| EP | 0 917 404 | 5/1999 |
| EP | 1 428 959 A1 | 6/2004 |

OTHER PUBLICATIONS

UK Intellectual Property Office, Search Report for GB Patent Application No. 0724997.2, dated Apr. 11, 2008, 1 page.
International Preliminary Report on Patentability, Written Opinion of the International Searching Authority, International Application No. PCT/EP2008/010587, dated Dec. 12, 2008, 9 pages.

* cited by examiner

CONTROLLED DOOR OPENING IN DOMESTIC APPLIANCES

RELATED APPLICATIONS

The present application is a 35 U.S.C. §371 national phase application of PCT International Application No. PCT/EP2008/010587, filed Dec. 12, 2008, which claims priority from Great Britain Patent Application No. 0724997.2, filed Dec. 21, 2007, the disclosures of which are hereby incorporated herein by reference in their entireties. The above PCT International Application was published in the English language and has International Publication No. WO 2009/080229.

FIELD OF THE INVENTION

The present invention relates to domestic appliances, and more particularly to a controllable door opening mechanism for such domestic appliances.

BACKGROUND

This invention concerns domestic appliances having a hinged door, such as ovens, fridges, freezers and the like. The invention is, for example, particularly beneficial in relation to microwave ovens. However, the invention is applicable to electrical domestic appliances whether free-standing or adapted for built-in installation, i.e. installed within a framework or outer housing, or are mounted with kitchen or other household furniture (sometimes known as "slot-in" or "built-in" appliances).

It is conventional for microwave ovens, and other electrical domestic appliances with doors, to employ a purely mechanical, e.g. latched, opening mechanism for the door. For example, published UK patent application GB2410059A discloses domestic electrical appliance such as a refrigerator or microwave oven, with a door that is laterally hinged between a lower supporting hinge and an upper hinge. The upper hinge comprises an angled bracket with a projecting portion and the upper edge of the door is provided with a ramp-shaped slide block that progressively interferes with the projecting portion when the door is opened to angles greater than a predetermined value, for example 130-140 degrees, exerting an increasing resistant torque as the angle of opening increases.

A problem with conventional appliances is that often, the user must apply considerable force, to a lever, handle or button, to mechanically release the latch or door lock in order to open the door; thus, for example, this can be problematic or unsatisfactory for the disabled and frail to use. Further, for such users, as well as the able bodied, such prior art mechanisms require the user to be physically present at the device to apply the force to open the door. Also, from a cosmetic point of view, a handle or a large mechanical push button for door opening could be considered to be unsightly.

A further problem, particularly in relation to microwave ovens, is that they do not support automatic (or remote-controlled) opening of the door immediately, or some relatively short time after, cooking is finished (i.e. application of microwave power ceases). For example, it may be undesirable for hot, often steaming, food to remain standing in the oven with the door closed, and there is often a direction associated with the food or meal for it to be left standing in the "open" for some moments, prior to serving.

SUMMARY

The present invention provides a door opening mechanism for a domestic appliance, the domestic appliance including a housing, a front door, and a resilient member, for urging the door open, wherein the door opening mechanism is adapted to be located within the housing; the door opening mechanism comprising: a retention mechanism, engageable with the door and movable between a first configuration, in which the door is retained in a closed position, and a second configuration, in which the door is non-engaged; a cam, the cam having a plurality of cam surfaces, each cam surface being adapted to move the retention mechanism out of said first configuration through camming action; and a rotary motor, for driving the cam in response to control signals.

Preferably, the cam comprises a plurality of equally angularly spaced projections, the outer surfaces of the cam between successive projections comprising a cam surface. Preferably, each cam surface comprises of two slopes, one slope for clockwise cam motion and the other slope for anticlockwise cam motion, both slopes cooperating with the retention mechanism as it moves from the first configuration to the second configuration, thus opening the door. Preferably, each projection forms a transition point between first and second configurations.

Alternatively or additionally, each cam surface comprises a first part, for cooperating with the retention mechanism as it moves into the first configuration, and a second part, for cooperating with the retention mechanism as it moves from the first configuration to the second configuration. Alternatively or additionally, each projection forms a transition point between a first part of one cam surface and a second part of a subsequent cam surface.

The mechanism may be (i) operable in both clockwise and anticlockwise camming motion, (ii) clockwise camming action only or (iii) anticlockwise camming action only. The cam may have 1 to 10 cam surfaces, more preferably 3-5 cam surfaces, and more preferably 4 cam surfaces.

Preferably, the resilient member comprises a first spring biasing element, for example a coil spring.

Preferably, the retention mechanism includes a rotatable member rotated, in use, by the cam while the motor is activated; and a second spring biasing element; wherein, in use, during at least part of the movement of the retention mechanism between the first configuration and the second configuration, the second spring biasing element acts to urge the retention mechanism into the first configuration. Preferably, the rotatable member includes an engagement surface, for sliding engagement, in use, with a cam surface on the cam.

Preferably, the rotatable member has a guide surface, the guide surface including a transition point and being disposed such that, in use, a key member attached to the door is capable of sliding contact with the rotatable member along the guide surface; wherein, after the key member has slid beyond the transition point, forces due to gravity and to the spring biasing element operate on the door such that the door rotates to the partially open position.

According to another aspect of the invention there is provided a domestic appliance, comprising: a housing, a front door, a resilient member, for urging the door open, the door opening mechanism of any of claims 1 to 8 of the appended claims, and a controller, coupled to the motor, the controller being operable in response to one or more signals to activate the motor, and thereby cause the door to move open.

Preferably, the resilient member comprises a first spring biasing element, for example a coil spring.

The appliance preferably further includes a microswitch, positioned for engagement by successive projections, and being in a closed state when the retention mechanism is in the first configuration.

In one embodiment, the controller is operable in a switch-activated mode; the housing is provided thereon with an electrical switch, for example a touch switch, coupled to the controller and operable by a user; and the controller is operable, in use, to activate said actuator when the detected signal from said electrical switch is HIGH.

In another embodiment, the controller is alternatively or additionally operable in a remote activated mode; the housing is provided thereon with a wireless receiver unit, for example an infra-red (IR) receiver, coupled to the controller and operable by a user remote unit, for example an IR remote control; and the controller is operable, in use, to activate said actuator when the detected signal from said wireless receiver unit is HIGH.

In another embodiment, the controller is alternatively or additionally operable in an auto-open mode, the housing is provided thereon with a user selection interface, for example buttons and/or dials and a display, coupled to the controller and operable by a user, the user selection interface including an auto-open setting selectable, in use, by the user; the controller is coupled for receiving an input signal (HIGH, LOW), indicative of whether the electrical operation (e.g. cooking operation) in the appliance is on or off, respectively; and the controller is operable, in use, to activate said actuator when the received signal is LOW.

In another embodiment, the appliance is capable of performing a temporary electrical operation, wherein: the controller is alternatively or additionally operable in an delayed auto-open mode; the controller is coupled to a memory device, for storing a time period; the controller is coupled for receiving an input signal (HIGH, LOW), indicative of whether the electrical operation (e.g. cooking operation) in the appliance is on or off, respectively; and whereby the controller is operable, in use, to activate said actuator when the controller determines that (a) the received signal is LOW, and (b) said time period has elapsed.

The user selection interface may include a delayed auto-open setting selectable, in use, by the user; wherein the user selection interface is operable by the user for inputting said time period prior to storage in the memory device. The time period may be approximately (a) 1-20 seconds, (b) up to 1 minute, or (c) 1-5 minutes.

Alternatively, instead of being operable in response to a detected or received signal being HIGH, the controller is operable in response to (a) the detected or received signal being LOW, or (b) vice versa, or (c) the detected or received signal undergoing any predetermined detectable change in state or voltage level.

The motor may be operable in both clockwise and anti-clockwise directions, thereby enabling movement of the retention mechanism in either direction. Alternatively, a motor operable in one direction only (e.g. clockwise only) may be used to move the retention mechanism out of said position.

The appliance may be (a) an oven, and the temporary electrical operation is cooking by means of any combination of microwave, grill, convention or steaming, or (b) a bread-maker, yoghurt maker or the like, and the temporary electrical operation is electrical warming or heating.

Using techniques according to the invention, appliances such as microwave ovens can be opened with very little manual effort from the user, e.g. via touch switch or remote control, benefiting those of a frail disposition.

The invention enables the appliance to open automatically, such as the end of electrical (microwave, grill, convective) cooking. This can reduce the amount of moisture build-up on the interior of the oven due to steam.

The invention allows the design of an appliance free of handles and large mechanical buttons. This makes cleaning easier, as well as being valuable from a cosmetic point of view, in that a handle may be considered to be unsightly or in that the visible front face of the appliance is desired to be of 'flat' design. It also means that the invention can be applied to freestanding or built in appliances.

A further feature is that, as the invention entails an opening means, as opposed to a locking means, it allows the user to manually override the opening mechanism and physically open the door at anytime by means of pulling, thus negating problems associative with a power failure. The invention allows the user, upon pressing the door release button, to immediately see a response: the door opening mechanism is underway and the user will start to see the door opening. On the other hand, if it were desired to have delays (for example, for in-built 'stand times' to be part of the cooking programme), they could easily be integrated into the controller software. As the opening mechanism is operable with a rotary motor capable of rotating in both clockwise and counter-clockwise directions, clockwise only and anticlockwise only directions, a vast variety of motors can be used; including most types of AC motors and DC motors.

BRIEF DESCRIPTION OF THE DRAWINGS

Embodiments of the invention will now be described in detail, by way of example, with reference to the accompanying drawings, in which.

DETAILED DESCRIPTION OF EMBODIMENTS OF THE INVENTION

In the description and drawings, like numerals are used to designate like elements.

Figure 1:
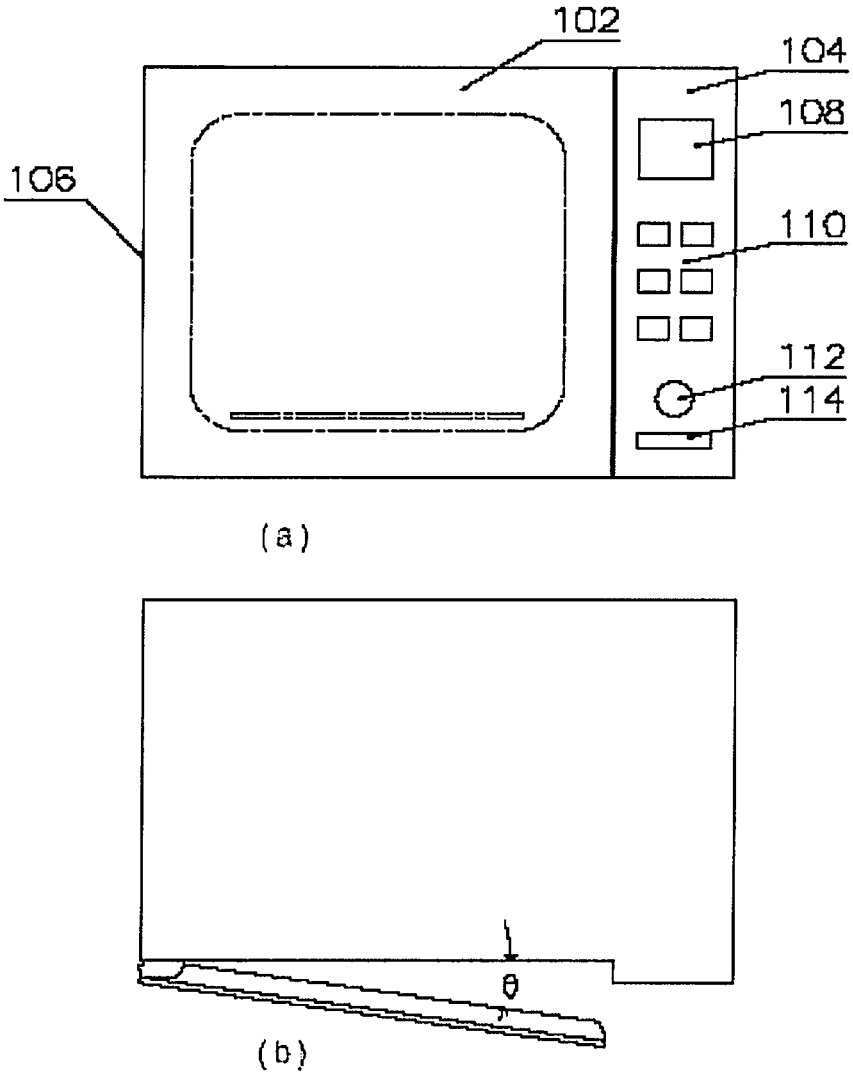
FIG. 1 shows a domestic appliance (microwave oven) in accordance with an embodiment of the present invention (a) in front view, and (b) in plan view following door opening.

FIG. 1 shows a domestic appliance (microwave oven) incorporating a door opening mechanism in accordance with an embodiment of the present invention (a) in front view, and (b) in plan view following door opening. Referring to FIG. 1(*a*), this shows the door 102 of the oven and the right hand control panel 104. The door 102 is hinged at the left side 106, as is conventional (although this invention is just as applicable to a door hinged at the right hand side, top or bottom).

In the control panel 104 is a display 108, typically a LED numeric display, for example displaying current time and remaining cooking time; however, it will be appreciated that many forms of display, e.g. LCD, may be used. Also provided are a number of control/selection buttons 110, a dial 112 and a door release switch 114. In accordance with this embodiment of the invention, the control/selection buttons 110 and the door release switch 114 are of the momentary switch type, or more preferably the touch switch type. Persons skilled in the art will appreciate that well-known membrane, tactile or touch switch components, any or any other similar switch types may be used.

Referring to FIG. 1(*b*), this shows the microwave oven in plan view following door opening, i.e. following user actuation of the door release switch 114, or though other initiation of the door opening mechanism, to be described hereinafter. As a result, the door has opened by an angle θ, which may be of the order 30-45 degrees, thus enabling the user to then fully open the door 102. Of course, the initial opening angle θ may be some finite angle less than 30 degrees, or may be greater than 45 degrees; it will be appreciated that the mechanism may open the door by anything up to about 90 degrees (e.g. for built-in appliances), and possibly more (e.g. anything up to about 180 degrees for free-standing units).

Figure 2:
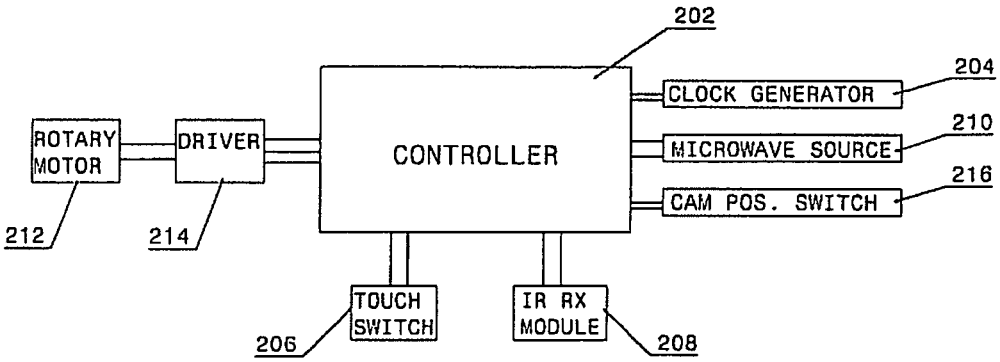
FIG. 2 illustrates part of the electrical system for the microwave oven of FIG. 1.
Figure 3A:
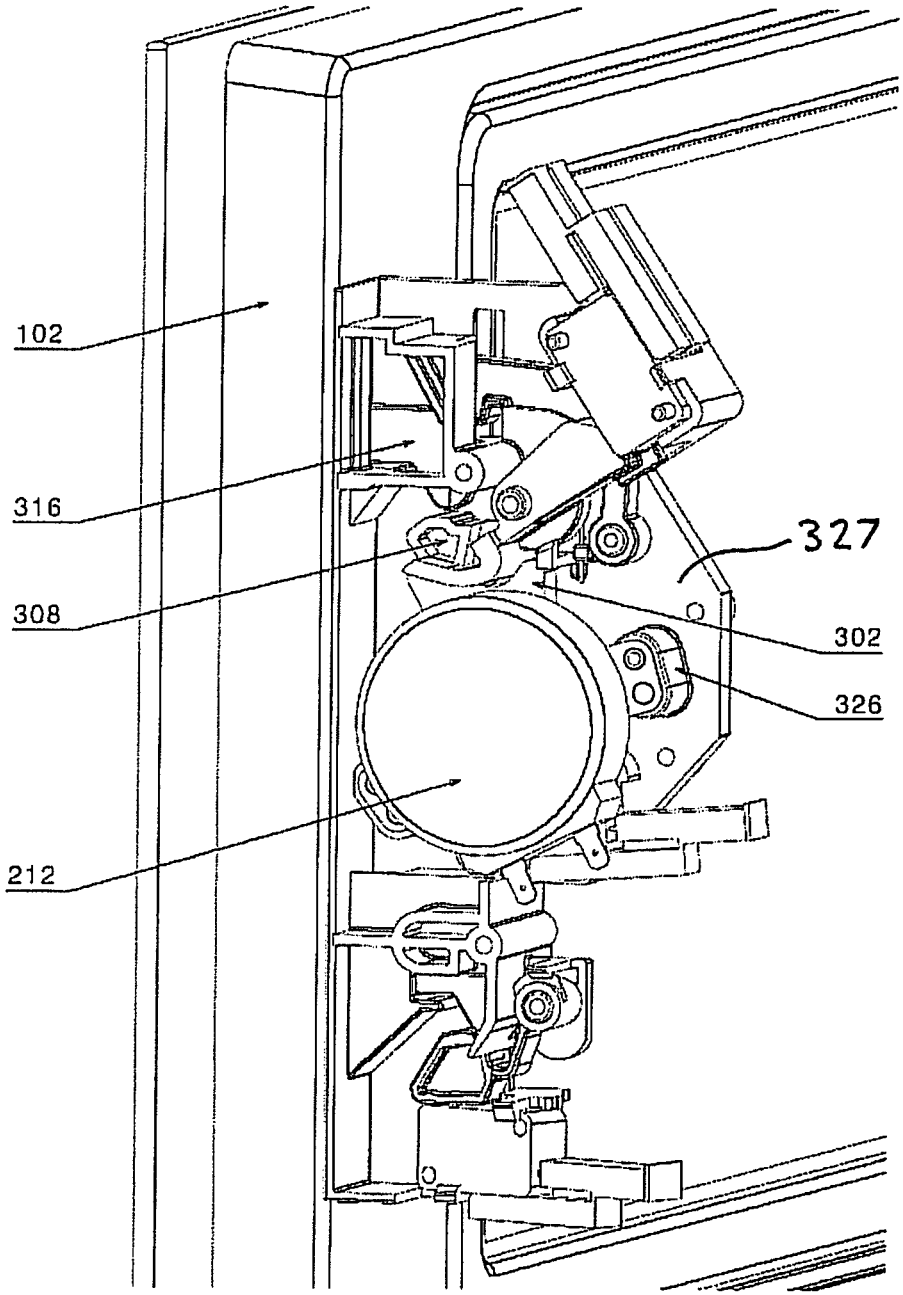
FIG. 3 depicts partial internal views of the oven of FIG. 1, showing the door opening mechanism, and operation thereof, in accordance with embodiments of the present invention, (a) a general arrangement of key components, (b) with the door in the closed position, (c) at the half travel point, and (d) at the door open position.
Figure 3B:
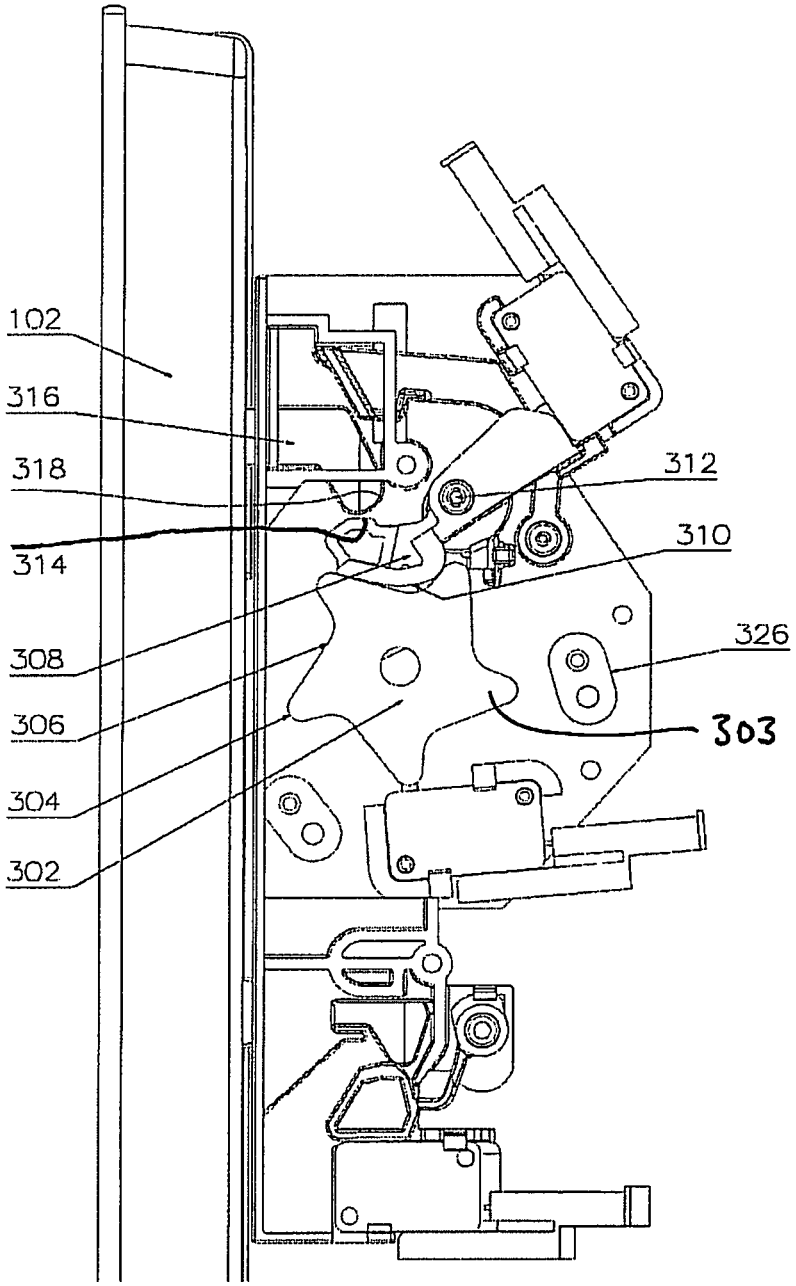
Figure 3C:
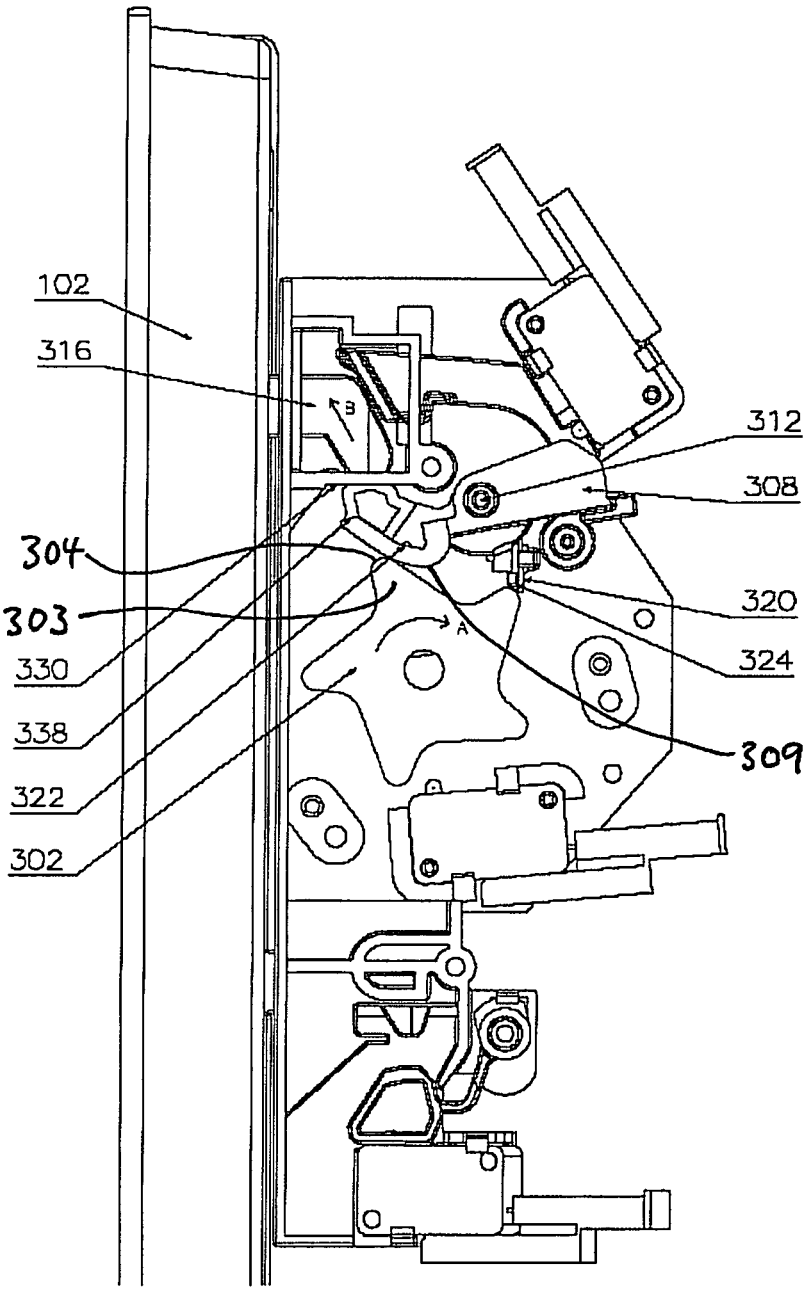
Figure 3D:
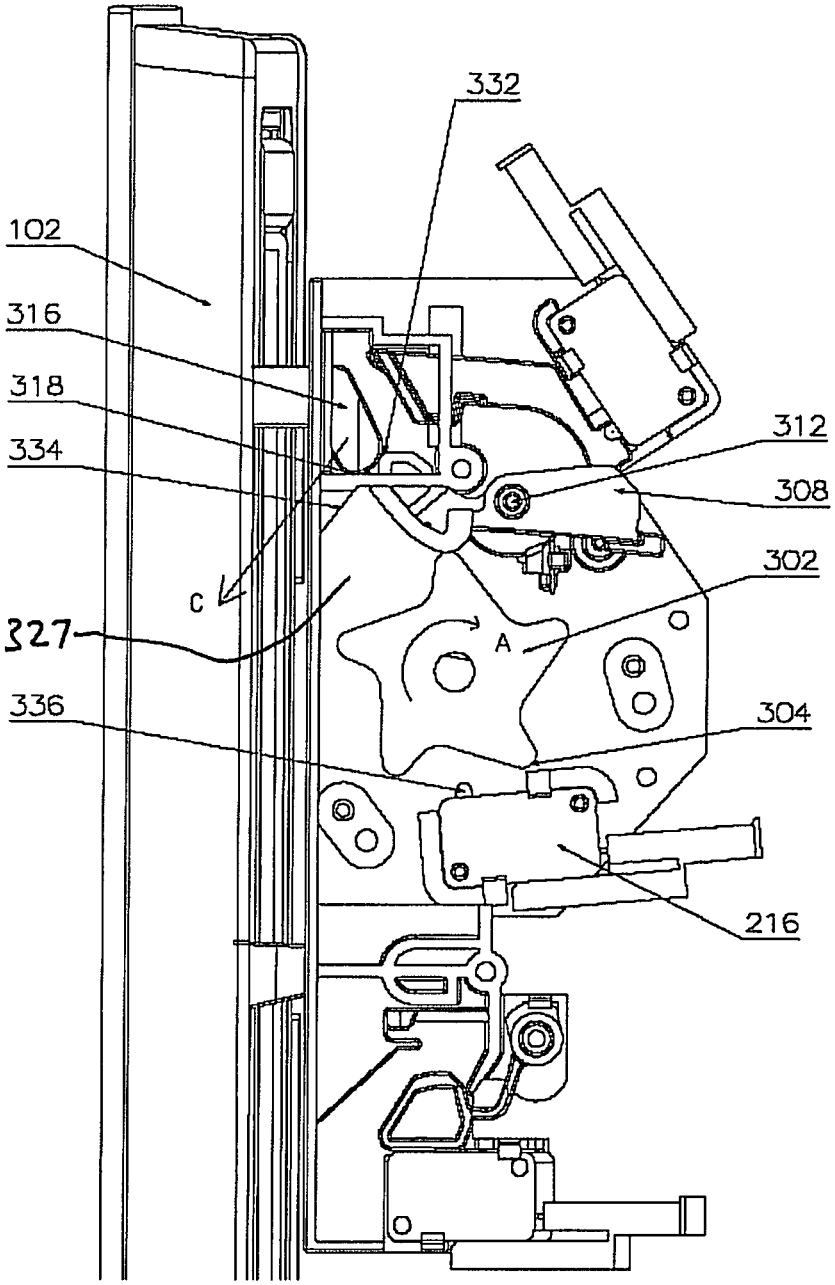

FIG. 2 illustrates part of the electrical system for the microwave oven of FIG. 1. As can be seen, the circuit includes a controller 202 (e.g. microprocessor controller). Coupled to the controller 202 is clock generator 204, cam positioning switch 216, touch switch 206 and IR receiver module 208. The controller 202 also receives at one of its inputs a signal via line 210 from the microwave power circuit, indicative of whether microwave power in the appliance is off or on. As is conventional, the controller may be coupled to RAM, ROM or other suitable memory devices (not shown), the latter storing, among other things, system setting, and settings (e.g. auto-open, time-delayed auto-open) that may have been input by the user via control panel 104 (FIG. 1).

Based on the status of the inputs from the touch switch 206 and the IR receiver module 208, the controller 202 controls the actuation of rotary motor 212 via driver circuit 214. Thus, the controller 202 is able to implement several modes of door opening—

(i) Following user actuation of touch switch, (ii) Automatically after microwave power goes off, (iii) Automatically a certain time after microwave power going off, and (iv) Following receipt of command via IR remote control.

Alternatively, the door may be opened as a result of some other predefined sequence, such as prompting the user to stir or turn over food currently being cooked (or any other hardware input or internal decision by the controller).

There is shown, in Appendix A hereafter, a pseudo-code description of just one example of a procedure for use by the controller 202 for controlling the actuation of rotary motor 212. However, it will be appreciated by persons skilled in the art that other suitable procedure may be used to implement some or all of the techniques according to embodiments of the invention.

Upon activation of rotary motor 212 the controller 202 will keep rotary motor 212 operational until a signal(s) has fed back to the controller 202 to de-activate rotary motor 212. In accordance with embodiments of the invention, a feedback signal from a cam-positioning switch 216 indicates that the cam 302 (see FIG. 3) is in the correct start/stop position. In another embodiment, there may be feedback from clock generator 204 indicating that a limit timer has passed.

If power is cut off to rotary motor 212 at any time, upon regaining power, controller 202 checks if cam 302 (see FIG. 3) is in the correct start/stop position (by means of checking the status of cam-positioning switch 216). If not, then controller 202 activates rotary motor 212 until the cam 302 is in its correct start/stop position.

FIG. 3 depicts partial internal views of the oven of FIG. 1, showing the door opening mechanism, and operation thereof, in accordance with embodiments of the present invention, (a) a general arrangement of key components, (b) with the door in the closed position, (c) at the half travel point, and (d) at the door open position.

Referring to FIG. 3(*a*), the body of rotary motor 212 is mounted onto raised tabs 326 of the door hook moulding 327. Rotary motor 212 includes a shaft (not shown) whose free end is held straight by a hollowed raised tab (not shown) on the underneath of the door hook moulding 327, which thus acts as a bushing. Fitted onto the shaft (not shown) of rotary motor 212 is cam 302 which acts upon hook spacer 308. As is discussed further hereinafter, during the door opening sequence in which the shaft of rotary motor 212 rotates, the hook spacer 308 is caused to simultaneously act upon door key 316, which is attached to door 102.

In FIGS. 3(*b*) to 3(*d*), rotary motor 212 has been removed, for the sake of clarity. FIG. 3(*b*) shows cam 302 and its arms or projections 303 having smoothed rounded ends 304. Between successive ends 304 are defined camming surfaces 306 (parallel to the axis of rotation), the camming surfaces 306 having a specific profile that abuts, during the door opening action, a matching rounded profile 310 of hook spacer 308. In FIG. 3(*b*), cam 302 is shown to be in the correct start/stop position for the door opening sequence. During the door opening action the profiles of the cam surfaces 306 and hook spacer 310 slide over each other forcing the hook spacer 308 to rotate (clockwise) about axis 312, and a first sloping portion 314 of the hook spacer 308 abuts and pushes upwards upon a tip 318 of door key 316. The profile of each cam surface 306 and the profile of the hook spacer 310 are specifically designed such that cam 302 may drive the hook spacer 308 whilst rotating in either the clockwise and counter-clockwise direction.

Accordingly, at the half travel point (FIG. 3(*c*)), through the rotary motor 212 and cam 302 having traveled in a clockwise manner as shown by arrow A, the door key 316, attached to the door 102 (which is under spring bias (not shown) urging it to open), has moved upwards in the direction of arrow B and is close to the release point of the door 102. As will also be seen, a coil spring 320 is provided, centred on the axis 312 and having one end fixed to door hook moulding 327 by a clamp 324. The other end (not shown) of the coil spring 320 is attached to, and acts upon, hook spacer 308 at position 322 to return it to the "door open" position—in which face 338 abuts against the hook spacer stop 330—after the tip 304 of cam arm 303 has passed the apex 309 on the hook spacer 308.

Referring to FIG. 3(*d*), at the point indicated therein, the door is effectively released: the tip 318 of door key 316 has passed the corner 332 of hook spacer 308, and door key 316 is free to move. Urged by a coil spring (not shown) located within the door housing (not shown) acting downwards on door key 316, the latter is pulled down a sloping section 334 of a hollow slot of the door hook moulding 327 (i.e. in the direction of arrow C), thereby pushing the door 102 to an open position (in FIG. 3(*d*), the door is indicated as partially open by a small angle).

Thereafter, following the door opening sequence, cam 302 continues to rotate, until one of the rounded tips 304 of the cam arms 303 compresses and activates micro-switch 216 at point 336. At this stage, the cam 302 is in the correct start/stop position to receive hook spacer 308 when the door is next closed, i.e. in the same relative position as when at the start of the door opening sequence (see FIG. 3(*b*)).

If, for any reason, the power to rotary motor 212 is cut off, the user is able to manually override the opening mechanism and physically open 102 the door at anytime by means of pulling. If the power is cut off to rotary motor 212 during a door opening sequence, it will remain possible to close door 102, since the door key 316, if necessary, is able to displace rotary motor 212 and cam 302 upon shutting door 102.

APPENDIX A

```
While system is on do
Sense cooking power status; Sense touch switch status;
Sense IR receiver status; Sense auto-open setting: Sense
door open status; Sense cam position status
If door is open
  don't set actuator control signal HIGH
If touch switch is HIGH or IR receiver is HIGH
  set actuator control signal HIGH
If auto-open setting is on
  fetch time auto-open time period
  if auto-open time period is zero and actuator control
    signal is LOW
  then set actuator control signal HIGH
  else do
    count down auto-open time period
    while auto-open time period not expired
  while auto-open time period not expired
Sense cooking power status; Sense touch switch status;
  Sense IR receiver status; Sense auto-open setting:
  Sense door open status; Sense cam position status
  If door is open
    don't set actuator control signal HIGH
  If touch switch is HIGH or IR receiver is HIGH
    set actuator control signal HIGH
  If auto-open setting is on
    fetch time auto-open time period
    if auto-open time period is zero and actuator control
      signal is LOW
    then set actuator control signal HIGH
    else do
      count down auto-open time period
      while auto-open time period not expired
    while auto-open time period not expired
```

The invention claimed is:

1. A door opening mechanism for a domestic appliance, the domestic appliance including a housing, a front door, and a resilient member, for urging the door open, the door opening mechanism comprising:

a retention mechanism, engageable with the door and movable between a first configuration, in which the door is retained, or capable of being retained, in a closed position, and a second configuration, in which the door is non-retained, in an open position;

a cam, the cam having a plurality of cam surfaces, each cam surface being adapted to move the retention mechanism out of said first configuration through camming action; and a rotary motor, for driving the cam in response to control signals;

wherein the door opening mechanism is adapted to be located within the housing;

wherein the door comprises a door key comprising an inclined portion engagable with an edge of a sloping section of a hollow slot in a moulding of the door, and configured such that a user is able to, by means of pulling: (1) manually over-ride the opening mechanism; and (2) open the door.

2. The door opening mechanism of claim 1, wherein the cam comprises a plurality of equally angularly spaced projections, the outer surfaces of the cam between successive projections comprising a cam surface.

3. The door opening mechanism of claim 2, wherein each projection forms a transition point between the first configuration and the second configuration.

4. The door opening mechanism of claim 2, wherein each projection forms a transition point between a first part of one cam surface and a second part of a subsequent cam surface.

5. The door opening mechanism of claim 1, wherein each cam surface comprises of two slopes, one slope for clockwise cam motion and the other slope for anticlockwise cam motion, both slopes cooperating with the retention mechanism as it moves between the first configuration to the second configuration.

6. The door opening mechanism of claim 1, wherein the cam has 3 to 5 cam surfaces.

7. The door opening mechanism of claim 1, wherein the resilient member comprises a first spring biasing element, for example a coil spring.

8. The door opening mechanism of claim 1, wherein the motor is operable in both directions, thereby enabling movement of the retention mechanism in either direction.

9. A door opening mechanism for a domestic appliance, the domestic appliance including a housing, a front door, and a resilient member, for urging the door open, the door opening mechanism comprising:

a retention mechanism, engageable with the door and movable between a first configuration, in which the door is retained, or capable of being retained, in a closed position, and a second configuration, in which the door is non-retained, in an open position;

a cam, the cam having a plurality of cam surfaces, each cam surface being adapted to move the retention mechanism out of said first configuration through camming action; and a rotary motor, for driving the cam in response to control signals;

wherein the door opening mechanism is adapted to be located within the housing;

wherein the resilient member comprises a first spring biasing element, for example a coil spring;

wherein the retention mechanism includes:

a rotatable member rotated, in use, by the cam while the motor is activated; and a second spring biasing element;

wherein, in use, during at least part of the movement of the retention mechanism between the first configuration and the second configuration, the second spring biasing element acts to urge the retention mechanism into the second configuration.

10. The door opening mechanism of claim 9, wherein the rotatable member includes an engagement surface, for sliding engagement, in use, with a cam surface on the cam.

11. The door opening mechanism of claim 9, wherein the rotatable member has a guide surface, the guide surface including a transition point and being disposed such that, in use, a key member attached to the door is capable of sliding contact with the rotatable member along the guide surface;

wherein, after the key member has slid beyond the transition point, forces due to gravity and to the first spring biasing element operate on the door such that the door rotates to the partially open position.

12. A domestic appliance, comprising:
a housing,
a front door,
a resilient member, for urging the door open,
a door opening mechanism adapted to be located within the housing, the door mechanism comprising:
a retention mechanism, engageable with the door and movable between a first configuration, in which the door is retained, or capable of being retained, in a closed position, and a second configuration, in which the door is non-retained, in an open position;
a cam, the cam having a plurality of cam surfaces, each cam surface being adapted to move the retention mechanism out of said first configuration through camming action; and
a rotary motor, for driving the cam in response to control signals; and,
a controller, coupled to the motor, the controller being operable in response to one or more signals to activate the motor, and thereby cause the door to move open;
wherein the front door comprises a door key comprising an inclined portion engagable with an edge of a sloping section of a hollow slot in a moulding of the door, and configured such that a user is able to, by means of pulling: (1) manually over-ride the opening mechanism; and (2) open the door.

13. The domestic appliance of claim 12, wherein the resilient member comprises a first spring biasing element, for example a coil spring.

14. The appliance of claim 12, further including a microswitch, positioned for engagement by successive projections of the cam, and being in a closed state when the retention mechanism is in the first configuration.

15. The appliance of claim 12, wherein:
the controller is alternatively or additionally operable in a remote activated mode;
the housing is provided thereon with a wireless receiver unit, for example an infra-red (IR) receiver, coupled to the controller and operable by a user remote unit, for example an IR remote control; and
the controller is operable, in use, to activate said motor when the detected signal from said wireless receiver unit is HIGH.

16. The appliance of claim 15, wherein the appliance is (a) an oven, and the temporary electrical operation is cooking by means of any combination of microwave, grill, convention or steaming, or (b) a breadmaker, yoghurt maker or the like, and the temporary electrical operation is electrical warming or heating.

17. The appliance of claim 12, the appliance being capable of performing a temporary electrical operation, wherein:
the controller is alternatively or additionally operable in an auto-open mode,
the housing is provided thereon with a user selection interface, for example buttons and/or dials and a display, coupled to the controller and operable by a user, the user selection interface including an auto-open setting selectable, in use, by the user;
the controller is coupled for receiving an input signal (HIGH, LOW), indicative of whether the electrical operation in the appliance is on or off, respectively; and
the controller is operable, in use, to activate said motor when the received signal is LOW.

18. The appliance of claim 12, the appliance being capable of performing a temporary electrical operation, wherein:
the controller is alternatively or additionally operable in an delayed auto-open mode;
the controller is coupled to a memory device, for storing a time period;
the controller is coupled for receiving an input signal (HIGH, LOW), indicative of whether the electrical operation in the appliance is on or off, respectively; and
whereby the controller is operable, in use, to activate said motor when the controller determines that
(a) the received signal is LOW, and
(b) said time period has elapsed.

19. The appliance of claim 18, wherein the user selection interface including an delayed auto-open setting selectable, in use, by the user;
wherein the user selection interface is operable by the user for inputting said time period prior to storage in the memory device.

20. The appliance of claim 18, wherein the time period is approximately (a) 1-20 seconds, (b) up to 1 minute, or (c) 1-5 minutes.

21. The appliance of claim 12, wherein, instead of being operable in response to a detected or received signal being HIGH, the controller is operable in response to (a) the detected or received signal being LOW, or (b) vice versa, or (c) the detected or received signal undergoing any predetermined detectable change in state or voltage level.

22. A domestic appliance, comprising:
a housing,
a front door,
a resilient member, for urging the door open,
a door opening mechanism adapted to be located within the housing, the door mechanism comprising:
a retention mechanism, engageable with the door and movable between a first configuration, in which the door is retained, or capable of being retained, in a closed position, and a second configuration, in which the door is non-retained, in an open position;
a cam, the cam having a plurality of cam surfaces, each cam surface being adapted to move the retention mechanism out of said first configuration through camming action; and
a rotary motor, for driving the cam in response to control signals; and,
a controller, coupled to the motor, the controller being operable in response to one or more signals to activate the motor, and thereby cause the door to move open;
wherein:
the controller is operable in a switch-activated mode;
the housing is provided thereon with an electrical switch, for example a touch switch, coupled to the controller and operable by a user; and
the controller is operable, in use, to activate said motor when the detected signal from said electrical switch is HIGH.

* * * * *